US007302786B2

(12) United States Patent
Oleandri et al.

(10) Patent No.: US 7,302,786 B2
(45) Date of Patent: Dec. 4, 2007

(54) METHOD AND DEVICE FOR WRAPPING PRODUCTS

(75) Inventors: Maurizio Oleandri, Bologna (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 109 days.

(21) Appl. No.: 10/567,332

(22) PCT Filed: Aug. 5, 2004

(86) PCT No.: PCT/IB2004/002545

§ 371 (c)(1),
(2), (4) Date: Feb. 6, 2006

(87) PCT Pub. No.: WO2005/014400

PCT Pub. Date: Feb. 17, 2005

(65) Prior Publication Data

US 2006/0201114 A1 Sep. 14, 2006

(30) Foreign Application Priority Data

Aug. 6, 2003 (IT) ..... BO2003A0481

(51) Int. Cl.

| | |
|---|---|
| ***B65B 11/00*** | (2006.01) |
| ***B65B 49/00*** | (2006.01) |
| ***B65B 61/24*** | (2006.01) |
| ***B65B 35/50*** | (2006.01) |
| ***B65D 85/62*** | (2006.01) |

(52) U.S. Cl. ..... 53/447; 53/466; 53/476; 53/540; 53/203; 53/226; 53/234; 206/499; 206/526

(58) Field of Classification Search ..... 53/476, 53/203, 461, 285, 370.2, 375.8, 447, 540, 53/234, 466, 226; 206/77.1, 499, 449, 526; *B65B 61/24*
See application file for complete search history.

(56) References Cited

U.S. PATENT DOCUMENTS

| | | | | |
|---|---|---|---|---|
| 1,445,622 | A * | 2/1923 | Cooper | 53/234 |
| 1,875,979 | A * | 9/1932 | Beutel | 53/463 |
| 2,297,432 | A * | 9/1942 | Rasch et al. | 53/464 |
| 2,603,047 | A | 7/1952 | Malhiot | |
| 2,723,516 | A | 11/1955 | Malhiot | |
| 3,338,024 | A * | 8/1967 | Maulini | 53/203 |

(Continued)

FOREIGN PATENT DOCUMENTS

| | | |
|---|---|---|
| EP | 0608823 | 8/1994 |

(Continued)

*Primary Examiner*—Stephen F. Gerrity
(74) *Attorney, Agent, or Firm*—Timothy J. Klima

(57) ABSTRACT

Products (2) presenting bevelled or rounded corner edges (35) are advanced singly and in succession along a predetermined path (P), each enveloped in a wrapper (11) of parallelepiped box-like shape, and directed ultimately into a station (15) where each product (2) is subjected to a finishing step that consists in deforming at least one part of the wrapper (11) and causing it thus to adhere to the surface of the relative product (2), in particular at the bevelled or rounded corner edges (35); thereafter, the finished products (2) are stacked and wrapped in respective stick packs (36) of which the longitudinal corner edges (38) will hug the corner edges (35) of the stacked products (2), adapting to the contours of the bevelled or rounded profile.

17 Claims, 4 Drawing Sheets

U.S. PATENT DOCUMENTS

| | | | | | |
|---|---|---|---|---|---|
| 3,380,227 | A | * | 4/1968 | Youngman et al. | 53/171 |
| 3,992,855 | A | * | 11/1976 | Palmieri et al. | 53/209 |
| 4,095,394 | A | * | 6/1978 | Evrard | 53/586 |
| 4,265,073 | A | * | 5/1981 | Seragnoli | 53/542 |
| 4,584,816 | A | * | 4/1986 | Mattei et al. | 53/171 |
| 5,098,012 | A | * | 3/1992 | Will | 229/87.01 |
| 5,301,489 | A | * | 4/1994 | Benedetti | 53/234 |
| 5,305,580 | A | * | 4/1994 | Draghetti | 53/465 |
| 5,410,858 | A | | 5/1995 | Osti | |
| 5,490,368 | A | * | 2/1996 | Spatafora | 53/234 |
| 5,555,982 | A | * | 9/1996 | Kuhn et al. | 206/746 |
| 5,775,063 | A | * | 7/1998 | Ikai et al. | 53/463 |
| 5,794,413 | A | | 8/1998 | Draghetti | |
| 5,839,253 | A | * | 11/1998 | Draghetti | 53/234 |
| 5,946,884 | A | * | 9/1999 | Nordstrom et al. | 53/225 |
| 6,223,506 | B1 | * | 5/2001 | Ghini et al. | 53/463 |
| 6,324,817 | B1 | * | 12/2001 | Ghini et al. | 53/466 |
| 6,516,589 | B1 | * | 2/2003 | Draghetti et al. | 53/466 |
| 6,606,840 | B2 | * | 8/2003 | Focke et al. | 53/461 |
| 6,708,466 | B2 | * | 3/2004 | Spatafora | 53/466 |

FOREIGN PATENT DOCUMENTS

| | | | |
|---|---|---|---|
| EP | 0771731 | | 5/1997 |
| EP | 0970889 | | 1/2000 |
| EP | 1176097 | | 1/2002 |
| GB | 2164913 | A * | 4/1986 |

* cited by examiner

METHOD AND DEVICE FOR WRAPPING PRODUCTS

This application is the National Phase of International Application PCT/IB2004/002545 filed Aug. 5, 2004 which designated the U.S. and that International Application was published under PCT Article 21(2) in English.

TECHNICAL FIELD

The present invention relates to a method of wrapping products.

In particular, the present invention finds useful application in the art field of wrapping edible products such as sweets, chocolates and the like, to which explicit reference is made in the following specification albeit implying no limitation in scope.

BACKGROUND ART

The prior art embraces packaging methods such as will form wrappers of substantially box-like appearance around single products of substantially parallelepiped shape, utilizing a succession of folder mechanisms designed to perform a series of steps in which the edges of the wrapper are closed around the product and thus caused to cover the relative flat faces of the parallelepiped form.

In the event that the shape of the products should happen to be other than substantially parallelepiped, such methods are unable to produce a wrapper that will adhere perfectly to the faces of the product, especially along or around the areas where the adjoining faces of the product meet one another.

This is the case, for example, with products of substantially parallelepiped geometry having rounded corners, as presented typically by tablets, or products of notably more complex shape.

For retailing purposes, finally, products of the type in question are assembled in groups and overwrapped to manufacture packs of the familiar stick type, which will always present an elongated parallelepiped appearance regardless of the shape presented by the single constituent products.

The object of the present invention is to set forth a method of wrapping each single product, such as will ensure that the shape of the single product is recognizable both individually and when assembled with others in a stick pack.

DISCLOSURE OF THE INVENTION

The stated object is realized in a method according to the present invention.

The stated object is realized similarly in a device such as will perform the aforementioned method, and in a stick pack obtainable by performing the selfsame method.

The invention will now be described in detail, by way of example, with the aid of the accompanying drawings, in which.

Figure 1:
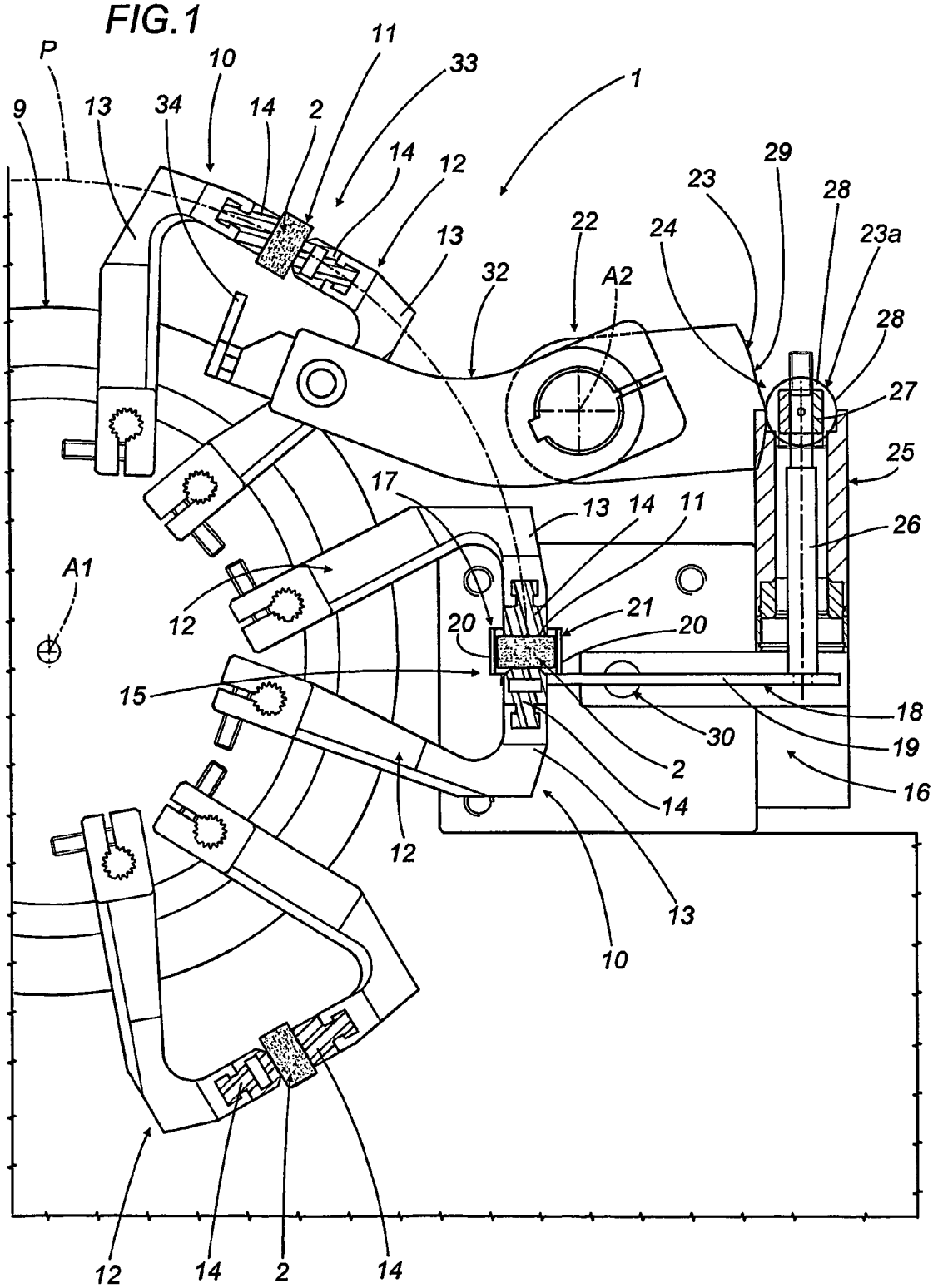
FIG. 1 shows a portion of a packaging machine in a schematic lateral view, with certain parts omitted, equipped with a device able to perform the method of wrapping products according to the present invention.

Referring to FIG. 1 of the drawings, 1 denotes a portion, in its entirety, of a wrapping machine for packaging products 2, and in particular, edible products 2 consisting for example in confectionery such as sweets, chocolates and the like.

Figure 5:
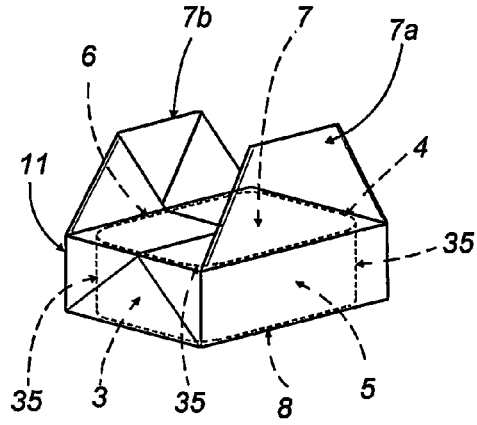
FIGS. 5 to 7 are perspective views showing a product enveloped in a respective wrapper and undergoing three different operating steps.
Figure 6:
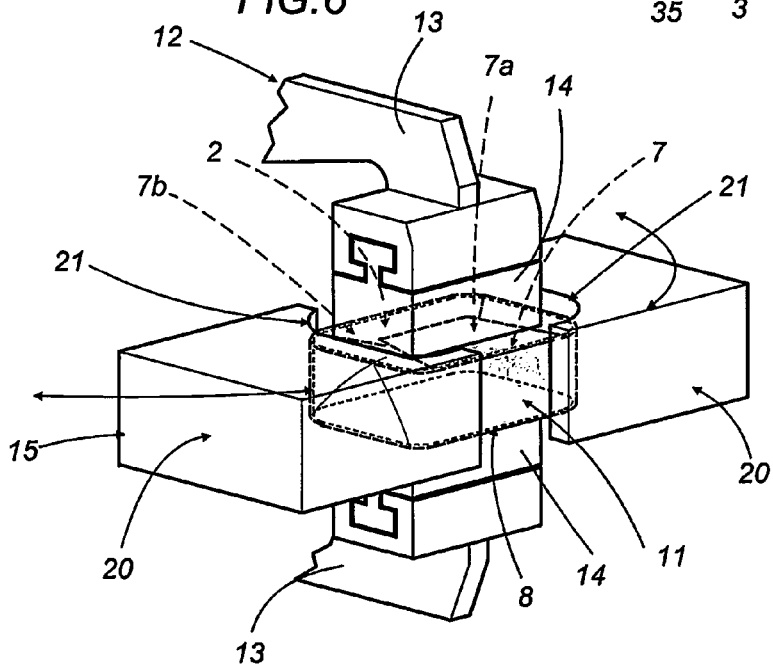
Figure 7:
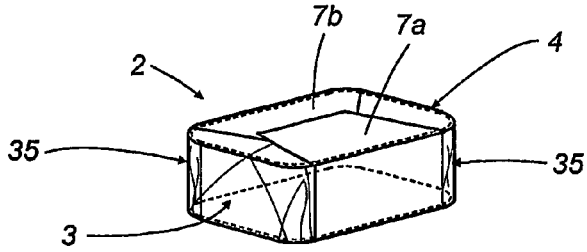

As illustrated by phantom lines in FIGS. 5, 6 and 7, each product 2 presents four lateral faces ordered as two substantially parallel pairs, namely, two end faces denoted 3 and 4, and two flank faces denoted 5 and 6. These lateral faces, together with two transversely disposed main faces 7 and 8, combine to create a substantially parallelepiped structure of which the corner edges 35 (disposed vertically, as viewed in the drawings) can be bevelled, or rounded as in the particular example illustrated.

The portion 1 of the wrapping machine is equipped with a conveyor 9 set in rotation intermittently about a respective horizontal axis A1 and comprising a plurality of first gripping means 10, each serving to take up a respective product 2 enveloped in a relative wrapper 11, formed previously in conventional manner, and direct it along a path P describing an arc and extending through stations not illustrated in the drawings.

The wrapper 11 shown in FIG. 5 presents a substantially parallelepiped box-like appearance with sharp corner edges, defined by six faces arranged in three mutually parallel pairs. In particular, the product 2 presents a main face 7 against which the wrapper 11 is closed by a final bending and securing step that involves flattening one fold 7*a* over another fold 7*b*.

Each of the aforementioned first means 10 comprises a gripper 12 furnished with two jaws 13 terminating in contact pads 14 by which the product 2 is seized from opposite sides, and more exactly the sides coinciding with the two main faces 7 and 8, in such a manner as to keep the folds 7*a* and 7*b* flattened against the relative face 7.

Observing FIG. 1, the machine comprises a finishing station 15 positioned along the conveying path P, equipped with a wrapping device 16 which in its turn comprises gripping and deforming means 17.

Figure 2:
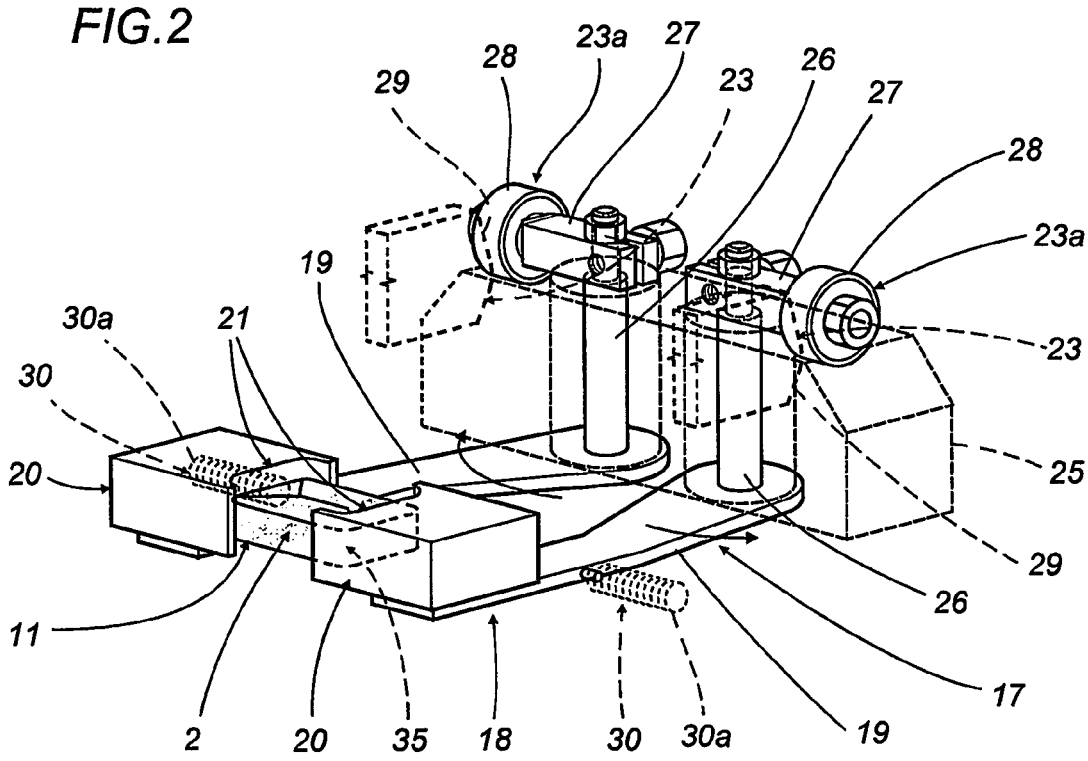
FIG. 2 shows the wrapping device of FIG. 1, viewed schematically and in perspective.
Figure 8:
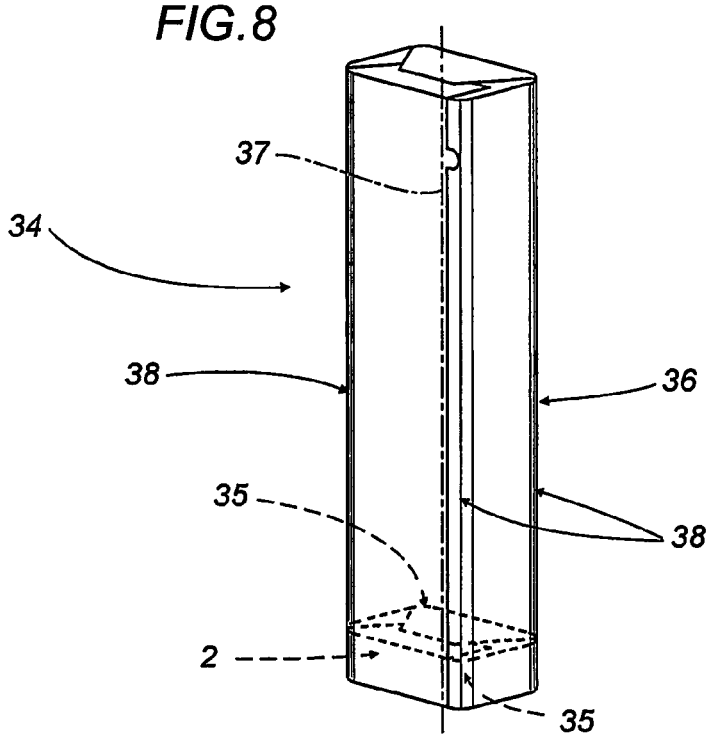
FIG. 8 is the perspective view of a stick pack containing a plurality of products obtained by the method of the present invention.
Figure 4:
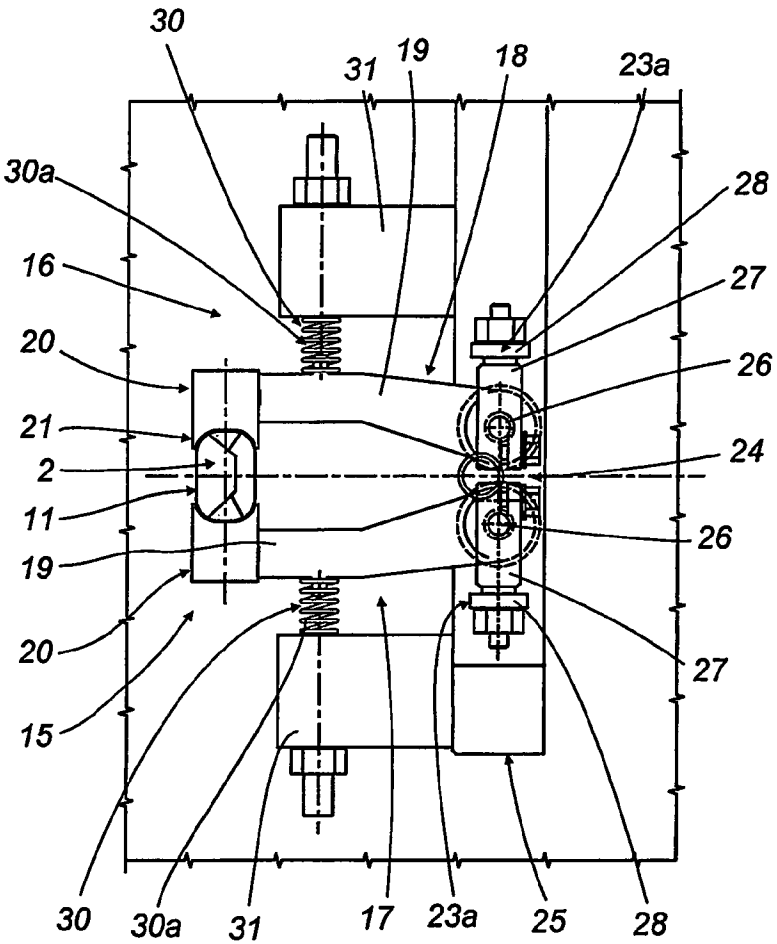
FIGS. 3 and 4 are plan views showing a detail of the device in FIG. 2, illustrated in two different operating conditions.
Figure 3:
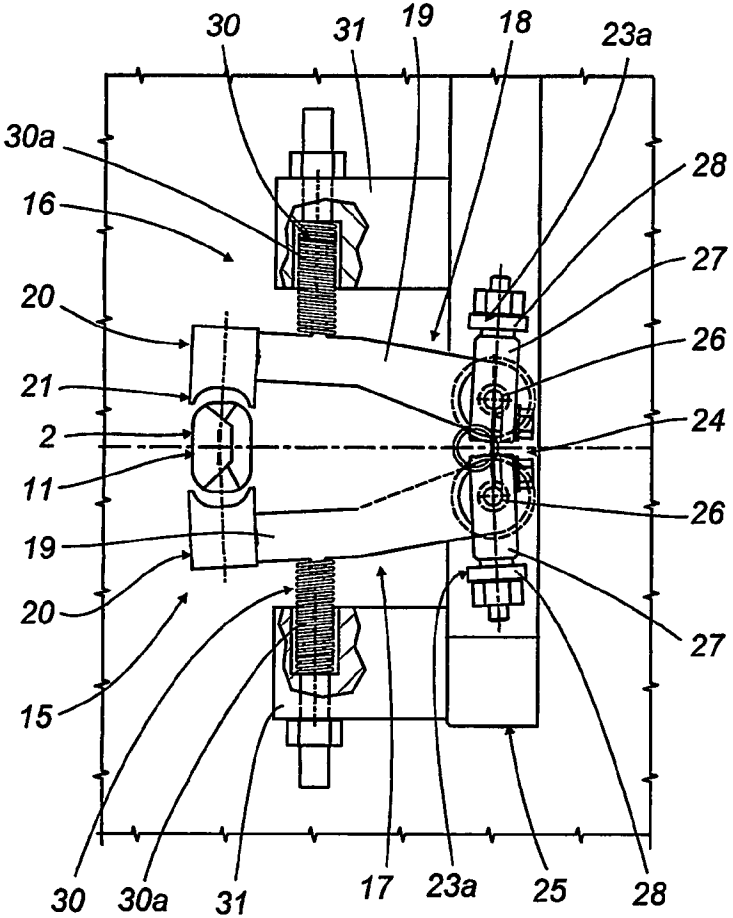

As illustrated in FIGS. 2, 3 and 4, in particular, the means 17 in question consist in a gripper 18 with a pair of jaws 19, one only of which is visible in FIG. 1, occupying a plane substantially normal to the plane occupied by the gripper 12 of the first means 10.

The ends of the jaws 19 are tipped with a pair of gripping and deforming pads 20, each presenting at least one flexibly resilient portion 21, arranged in such a way that the two portions 21 will close on the product 2 by engaging two opposite portions that coincide with the two end faces 3 and 4.

Observing FIG. 6, it will be seen that the resilient portion 21 of each pad 20 is shaped so as to match the contours of the product 2 at the rounded corner edges 35, and thus cause the wrapper 11 to adhere to the product 2 at the area subjected to the gripping and deforming action.

The jaws 19 illustrated in FIGS. 3 and 4 are capable of movement between two limit positions, namely a position of disengagement from the product 2 (shown in FIG. 3) and a position of engagement with the product 2, generated partly by drive means 22 comprising cam means 23 (see also FIG. 1) and respective cam follower means 23*a*.

More exactly, each jaw 19 of the gripper 18 is connected to a respective cam 23 by transmission means denoted 24 in their entirety and mounted in familiar manner to a block 25 indicated by phantom lines in FIG. 2.

In particular, each jaw 19 is rigidly associated with the bottom end of a vertical pin 26 connected at the top end by way of a horizontal arm 27 to a loose roller 28 such as can be engaged by a profile 29 of the respective cam means 23.

The jaws 19 are spread by the action of the cam means 23 as these are made to rock on an axis A2 disposed parallel to the axis A1 of rotation of the conveyor 9, through the agency of actuator means not illustrated in the drawings. The closing movement of the selfsame jaws 19, on the other hand, is generated by the action of spring means 30, and in particular of compression springs 30*a* interposed between each jaw 19 and a respective lug 31 cantilevered from the block 25.

Referring to FIG. 1, the device disclosed further comprises means, denoted 32, by which to flatten the one fold 7*a* over the other fold 7*b*, operating at a station 33 which occupies a position on the conveying path P lying upstream of the finishing station 15, and caused to rock on the aforementioned axis A2 by drive means not illustrated.

With each forward stroke, the flattening means 32 will advance a pair of bars 34, of which one only can be seen in FIG. 1, into contact with portions of the outermost fold 7*a* lying on either side of the relative pad 14, with the result that this fold 7*a* is pressed firmly against the fold 7*b* beneath.

In operation, the single products 2, each enveloped previously in the respective box-like wrapper 11 by wrapping means not illustrated in the drawings, are transferred by the intermittently driven conveyor 9 from an infeed station toward an outfeed station, neither of which is illustrated.

During the course of the transfer, more precisely, the product 2 remains held between the jaws 13 of the first gripper, its two main faces 7 and 8 in contact with the relative pads 14, and is directed by steps into the finishing station 15 where the jaws 19 of the second gripper will be occupying the spread position (indicated in FIG. 3), forced apart by the action of the cam means 23 as the profiles 29 engage the corresponding rollers 28 (see FIG. 1).

As the product 2 pauses at the station 15, the cam means 23 are caused by the drive means 22 to rotate clockwise as viewed in FIG. 1, with the result that the rollers 28 separate from the cam profiles 29 and the jaws 19 can be drawn together by the force of the springs 30*a*.

With the springs 30*a* impinging on the jaws 19, the gripping and deforming pads 20 will ensure that the parts of the wrapper 11 covering the end faces 3 and 4 of the product 2 are forced into close contact with the surface beneath, and more precisely with the aforementioned bevelled or rounded corner edges 35.

On completion of the deforming step, the drive means 22 are made to rotate anticlockwise about the relative axis A2, bringing the cam profiles 29 into contact once again with the rollers 28 as illustrated in FIG. 1.

Thereafter, the arms 27 rock back toward the position of FIG. 3 and cause the pins 26 to rotate, with the result that the jaws 19 are forced apart, overcoming the tension of the springs 30*a* and reassuming their spread position, distanced from the product 2.

At this juncture the conveyor 9 rotates through a further step about the relative axis A1, directing the finished product 2 toward a successive outfeed station and bringing a further product 2 into the finishing station 15.

The finished products 2, each with the relative wrapper 11 pressed tightly against the end faces 3 and 4 and the corner edges 35 as illustrated in FIG. 7, are assembled and enveloped in a leaf of wrapping material to form a stick pack 36, aligned on a predominating longitudinal axis denoted 37, of which the respective areas 38 between the adjoining side faces appear bevelled or rounded by virtue of the fact that the wrapping material is able to hug the corner edges 35 of the products 2 stacked along the axis 37.

The invention claimed is:

1. A method of wrapping products of substantially parallelepiped appearance with corner edges presenting a beveled or rounded profile, comprising the steps of:

conveying a succession of said wrapped products, each previously enveloped in a wrapper of substantially parallelepiped box-like appearance, along a predetermined path;

subjecting each of said wrapped products, in the course of its progress along the path, to a finishing operation that comprises deforming at least parts of the wrapper in such a way as will cause the selfsame wrapper to adhere closely to the surface of the relative product, the parts of the wrapper associated with two opposing end portions of the enveloped product being caused, in the course of the finishing step, to assume the same profile as the corner edges of the product.

2. A method as in claim 1, comprising the further steps of assembling the wrapped products into a group and enveloping the group in a leaf of wrapping material to form a stick pack aligned on a predominating longitudinal axis.

3. A method as in claim 1, wherein the conveying step involves a step of restraining the wrapped product by a respective gripping means applied to two first faces of the wrapped product.

4. A method as in claim 3, wherein the finishing step involves a step of engaging and compressing at least one part of each wrapped product by a flexibly resilient gripping and deforming means.

5. A method as in claim 4, wherein the engaging and compressing action of the gripping and deforming means is produced by a spring means.

6. A method as in claim 4, wherein the engaging and compressing action of the finishing step is applied by the gripping and deforming means in a direction transverse to the action of the gripping means, at least to two opposed portions of each of the wrapped products.

7. A method as in claim 6, wherein the finishing step is effected by the gripping and deforming means during the course of the restraining step effected by the gripping means.

8. A method as in claim 7, wherein the action of the gripping and deforming means is applied at least to the portions of each wrapped product destined, when assembled into a group having a plurality of longitudinal faces, to coincide with areas along which the longitudinal faces of the stick pack are joined one to another.

9. A device for finishing wrapped products of substantially parallelepiped appearance with corner edges presenting a beveled or rounded profile, comprising:

a conveyor, set in motion along a predetermined path and serving to advance a succession of said wrapped products, each previously enveloped in a respective wrapper of substantially parallelepiped box-like shape;

a finishing station positioned along the path and equipped with gripping and deforming means such as will engage and compress at least a part of each wrapped product in such a way as will cause the wrapper to adhere closely at least to the part of the product subjected to the gripping and deforming; and wherein the gripping and deforming means comprise at least one second gripper equipped with at least two jaws carrying respectively flexibly resilient gripping and deforming pads positionable respectively against two opposing end portions of each wrapped product for deforming the wrapper to assume the same profile as the corner edges of the product.

10. A device as in claim 9, wherein the conveyor comprises a plurality of gripping means, each serving to restrain a respective wrapped product.

11. A device as in claim 10, wherein the action of the gripping and deforming means is applied to the wrapped product in a direction transverse to the action of the gripping means.

12. A device as in claim 10, wherein the conveyor is a rotary conveyor set in rotation around a respective axis, and the gripping means comprise a plurality of first grippers mounted radially to and equispaced angularly around the periphery of the rotary conveyor.

13. A device as in claim 12, wherein the first grippers are furnished with resilient pads and designed to restrain the respective wrapped product by engaging two first faces of the wrapped product.

14. A device as in claim 9, comprising spring means acting on the gripping and deforming means in such a way as to shift the selfsame gripping and deforming means when applying the engaging and compressing action.

15. A device as in claim 14, wherein the second gripper comprises respective transmission means, operated by respective drive means, by which the respective jaws are moved between a limit position distanced from the wrapped product, opposing the engaging and compressing action of the spring means, and a limit position of engagement with the wrapped product, subject to the action of the spring means.

16. A device as in claim 15, wherein the drive means comprise cam means acting on respective cam follower means mounted to the drive means.

17. A stick pack comprising a group of wrapped products wrapped by the method of claim 2, enveloped in a leaf of wrapping material to form a stick aligned on a predominating longitudinal axis and having a plurality of longitudinal side faces, wherein areas along which the longitudinal side faces are joined one to another adhere closely to the portions of the wrapped products subjected to the action of the finishing operation so that the areas along which the longitudinal side faces are joined one to another have substantially the same profile as the corner edges of the wrapped products.

* * * * *